US005706976A

United States Patent [19]

Purkey

[11] Patent Number: 5,706,976

[45] Date of Patent: Jan. 13, 1998

[54] VENDING MACHINE INVENTORY CONTROL DEVICE

[76] Inventor: Jay Floyd Purkey, 940 Dollar Bay Dr., Lake Orion, Mich. 48362

[21] Appl. No.: 576,254

[22] Filed: Dec. 21, 1995

[51] Int. Cl.[6] ..... G07F 11/00

[52] U.S. Cl. ..... 221/6

[58] Field of Search ..... 222/2, 6, 8; 312/35, 312/42, 45, 49

[56] References Cited

U.S. PATENT DOCUMENTS

| | | | |
|---|---|---|---|
| 2,546,352 | 3/1951 | Weaver | 221/6 |
| 2,577,344 | 12/1951 | Masahe | 221/6 |
| 4,907,250 | 3/1990 | Ricks | 377/7 |
| 5,207,784 | 5/1993 | Schwartzendruber | 221/6 |
| 5,303,844 | 4/1994 | Muehlberger | 221/1 |

*Primary Examiner*—Kenneth Noland
*Attorney, Agent, or Firm*—Harness, Dickey & Pierce, P.L.C.

[57] ABSTRACT

A manual inventory control device and method of utilizing it is disclosed. The inventory control device includes a strip member and a method of attaching the strip member. The strip member has one or more sets of numbers positioned to coordinate with items of inventory held in a storage area for later distribution. The strip member is located such that the stored items block the view of a portion of the strip member, and as items are removed from storage a portion of the strip member containing numbers corresponding to the quantity of items remaining in the storage area is exposed. The exposed portion of the strip member may also contain a set of numbers indicating the quantity of items required to fill the storage area. The strip member may be utilized in vending machine applications and other product distribution applications where the inventory is sequentially removed.

16 Claims, 3 Drawing Sheets

VENDING MACHINE INVENTORY CONTROL DEVICE

TECHNICAL FIELD

The present invention generally relates to an inventory control device and, more particularly, to an inventory control device for use in vending machines and other systems where products are stored and later distributed from the storage area.

BACKGROUND OF THE INVENTION

The vending machine supply industry has traditionally been a labor intensive effort considering the large number of machines, the remote locations of these machines, and the wide variety of product stored within each of the machines. Vending companies generally own the vending machines which they service and employ personnel to retrieve monies collected and replenish the stock of merchandise in the machines on a regular basis. In order to properly balance the amount of money retrieved against the amount of merchandise sold, it is critical that the number of each type of item sold be easily ascertainable by the service person. When considering that particular types of vending machines contain different types and quantities of merchandise, it becomes apparent that to accurately track the inventory for a single machine can be time consuming and difficult. When further considering the large number of machines that each service person is responsible for, it is readily apparent that an inventory tracking system must be employed in order to assure accurate tracking of the merchandise, and efficient utilization of the service person's time.

The following is a representative, though not exhaustive, list of patents showing various apparatus and systems of monitoring the inventory within a vending machine:

U.S. Pat. No. 4,907,250 to Ricks;

U.S. Pat. No. 5,207,784 to Schwartzendruber;

U.S. Pat. No. 5,303,844 to Muehlberger.

Each of the above referenced patents incorporates some type of electronic control system in order to monitor the inventory in each machine. Unfortunately, such electronic means can be expensive and often require each service person be equipped with a compatible electronic reading device or require a communication line from each vending machine to a central inventory control center.

The present invention is intended to be a cost effective manual inventory control device which may be applied to a wide variety of vending type applications.

SUMMARY OF THE INVENTION

The inventory control system of the present invention is employed for tracking discreet items stored in and dispensed from a device, the inventory control system being comprised of a storage area for storing the items prior to being dispensed, and a visual indication means for indicating the quantity of items remaining in the storage area. The visual indication means is located such that the non-dispensed items remaining in the storage area partially block the view of the visual indicator while the exposed portion of the visual indication means indicates the quantity of items remaining in the storage area. The visual indication means may further include a second indicator coordinated with the first indicator, the second indicator indicating the quantity of items required to fill the storage area.

In the preferred embodiment, the visual indication means is a generally planar strip fastened to a tray for items stored in a generally horizontal position, or attached to an adjacent wall for items stored in a generally vertical position. The planar strip having a set of numbers increasing in numeric value which correspond to the number of items which may be held in the storage area. The strip may also contain a second set of numbers decreasing in numeric value, starting at the same end as those that increase in numeric value, the decreasing numbers indicating the quantity of items required to fill the storage area.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
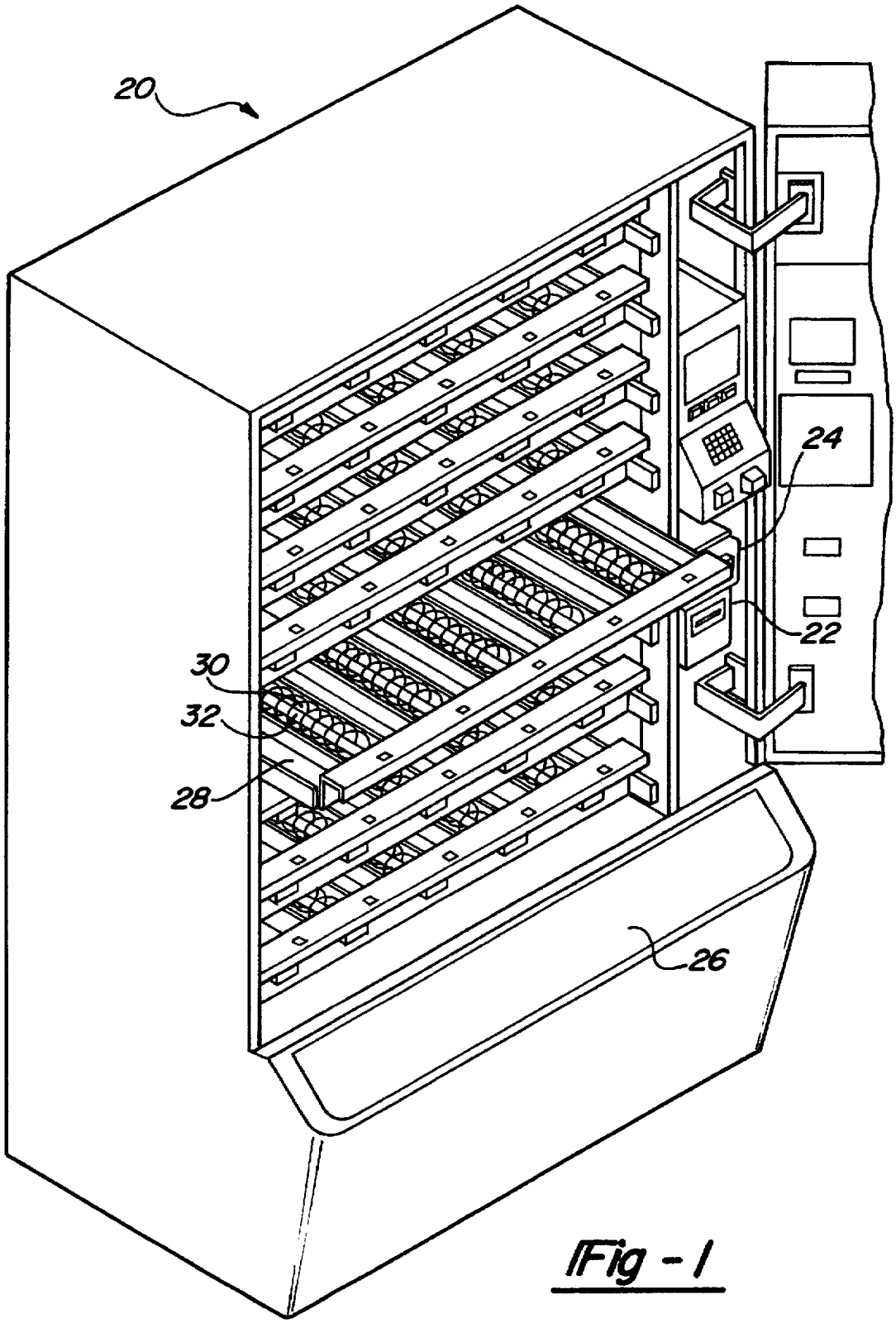
FIG. 1 is a perspective view of a vending machine incorporating the present invention.

With reference now to the drawings, particularly FIG. 1, there is shown a vending machine 20 incorporating the teachings of the present invention. As is common, vending machine 20 includes a money receptacle 22, a mechanism to provide correct change 24, a vending bin area 26, and a plurality of trays 28 which are moveable to allow ease of loading the items which are to be dispensed. Each tray 28 includes multiple storage and dispensing mechanisms 30 which hold the items and dispense the items when the appropriate selection is made. Positioned below each dispensing mechanism 30, and attached to tray 28, is a strip member 32 providing a visual indication of the inventory status in accordance with the teachings of the present invention.

Figure 2:
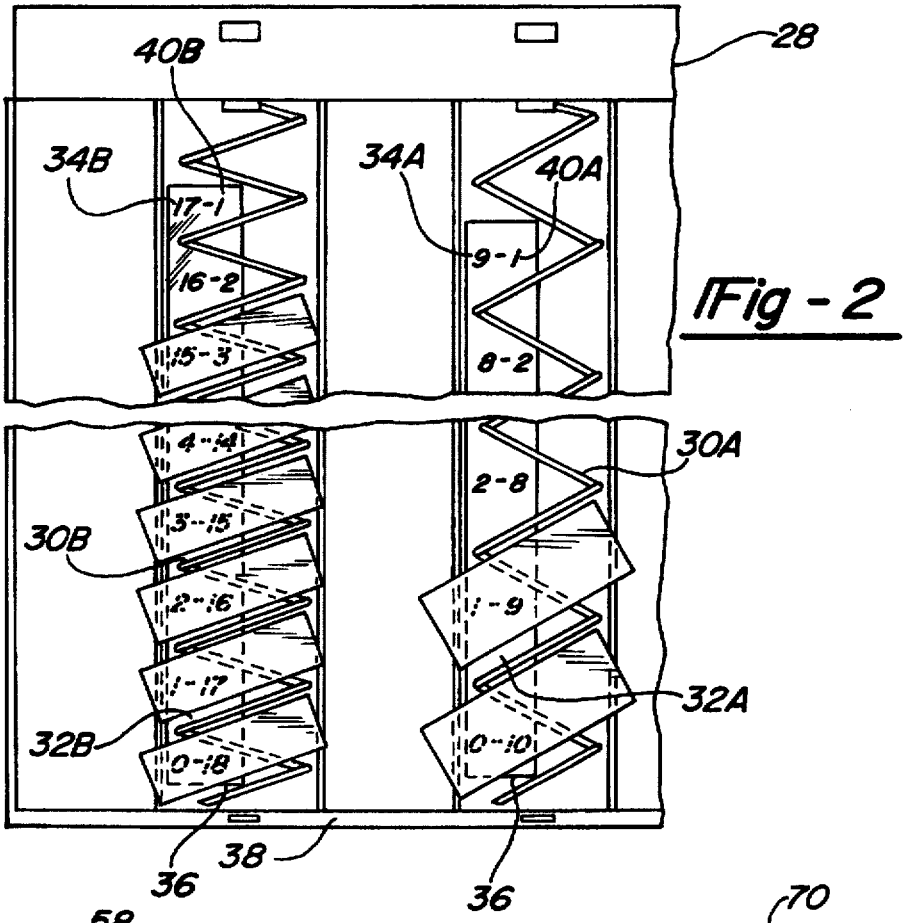
FIG. 2 is a plan view of one of the storage and distribution trays, incorporated in the vending machine of FIG. 1, having various holding capacity coils.

Referencing FIG. 2, tray 28 is shown to contain two dispensing mechanisms, 30A and 30B, which are horizontally positioned helical coils in the preferred embodiment. The flights, or spacing between coils, of mechanism 30A provides storage locations for ten items, whereas the flights of mechanism 30B are nearer to one another and provide storage locations for eighteen smaller items. Mechanisms 30A and 30B are rotatably connected to tray 28 and are rotatably driven by a drive motor (not shown) when a selection for an item stored in either 30A or 30B is made. The visual indication means of the present invention is shown as strip members 32A and 32B, which are attached to tray 28 either by adhesive on the back of the strip member, or by retention tabs formed in or attached to tray 28.

Strip members 32A and 32B include two sets of numbers, oriented to appear as pairs, which coordinate with each storage location of mechanism 30A and 30B. The first set of numbers 34A and 34B begin at a first end 36 of strip members 32A and 32B and increase in value as they travel away from the dispensing end 38 of mechanisms 30A and 30B. First sets 34A and 34B respectively indicate the number of items remaining in mechanisms 30A and 30B. The second set of numbers 40A and 40B begin at the first end 36 and proceed in decreasing numerical value as they proceed away from dispensing end 38. Second set 40A and 40B are indicative of the number of items required to fill mechanisms 30A and 30B, respectively.

Assuming all of the storage locations are filled in mechanisms 30A and 30B, and that a selection is made for one item in mechanism 30A and a seperate selection is made for one item in mechanism 30B; then as the items are dispensed from the dispensing end 38, each sequential item is forced forward and the last storage location is left vacant in each mechanism. This allows a portion of strip members 32A and 32B to become visible. Under the above-assumed conditions, the visible portion of members 32A and 32B would reveal pairs of numbers indicating that there are nine items remaining in mechanism 30A and one item is required to fill mechanism 30A, and that seventeen items remain in mechanism 30B and one item is required to fill mechanism 30B. Hence, the paired sets would appear as 9-1 and 1-1.

The above described process continues as each subsequent item is dispensed from mechanisms 30A and 30B, progressively exposing a greater portion of strip members 32A and 32B. FIG. 2 shows mechanism 30A, a ten item coil, having two items remaining and requiring eight items to fill the mechanism. Mechanism 30B, an eighteen item coil, is shown to have sixteen items remaining and requiring two items to fill the mechanism. It should be obvious to one skilled in the art that the number of items contained within each coil in the examples given are merely representative, and that a wide variety of storage locations are available depending upon the flight spacing and length of the coils utilized.

Figure 3:
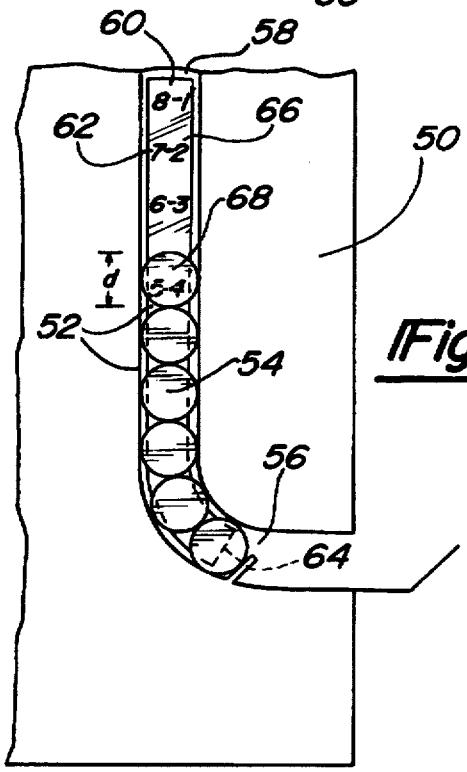
FIG. 3 is a sectional view of an alternate, vertically stacking type of vending machine incorporating the teachings of the present invention.

FIG. 3 depicts an alternate preferred embodiment of the present invention wherein the items for distribution are stacked in a generally vertical orientation as opposed to being contained in a horizontally positioned dispensing mechanism. The partial side view of FIG. 3 depicts a can storage system 50, often used for soda or juices, and is equally applicable to bottle storage systems of similar design.

Storage system 50 contains a storage area 52 which retains the stored cans 54 in a generally vertical orientation with a distribution end 56 near a lower portion of system 50. As cans 54 are dispensed through end 56, gravity acts to force subsequent cans to be lowered the distance of one can diameter -d-. Attached to a vertical wall 58 of storage area 52 is a strip member 60 acting as a visual indication means as taught by the present invention. Strip member 60 contains two sets of numbers, oriented to appear as pairs, which are incrementally spaced a distance equal to the diameter -d- of one can. The first set of numbers 62 begin at a first end 64 of strip member 60, which is coordinated with distribution end 56, and increase in value as they proceed away from end 64. First set 62 indicates the number of cans remaining in storage area 52. A second set of numbers 66, also beginning at first end 64, decrease in value as they proceed away from end 64 and indicate the number of cans required to fill storage area 52.

As cans are sequentially removed from distribution end 56, the remaining cans travel downward and progressively expose a greater portion of strip member 60, thereby exposing a greater number of paired sets of numbers. By observing the pair of numbers exposed immediately above the top can 68 remaining in storage area 52, a service person can quickly ascertain the number of cans sold and also the number of cans required to fill storage area 52. For example, FIG. 3 shows a storage area which has a capacity of nine cans, six of which remain in storage area 52. Therefore, the paired set of numbers which is visible immediately above can 68 is 6-3, indicating that six cans remain in storage area 52 and that three cans are required to fill storage area 52.

Strip member 60 may either be fastened to vertical wall 58 by means of an adhesive attached to strip member 60, or by means of retention clips incorporated in or fastened to vertical wall 58. Further, strip member 60 may also be incorporated in a vertically oriented point-of-sale product dispenser in a store where payment is made after the item has been selected.

Figure 4:
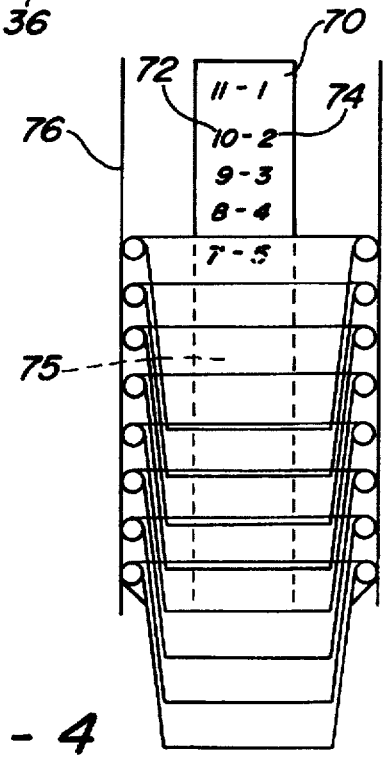
FIG. 4 is a side view of a cup storage area in a coffee or fountain soda machine containing the present invention.

FIG. 4 depicts a further application of the teachings of the present invention by utilizing a strip member 70, containing paired sets of numbers 72 and 74 as described above, to indicate the number of cups 75 remaining and the number of cups required to fill a cup storage area 76 in a coffee or fountain soda machine. Additionally, by tracking the number of cups dispensed since a coffee ground or soda syrup container was filled last the vending personnel will be able to determine, by knowing the amount of grounds or syrup required for each cup, when the coffee ground or soda syrup containers must be refilled or replaced.

Figure 5:
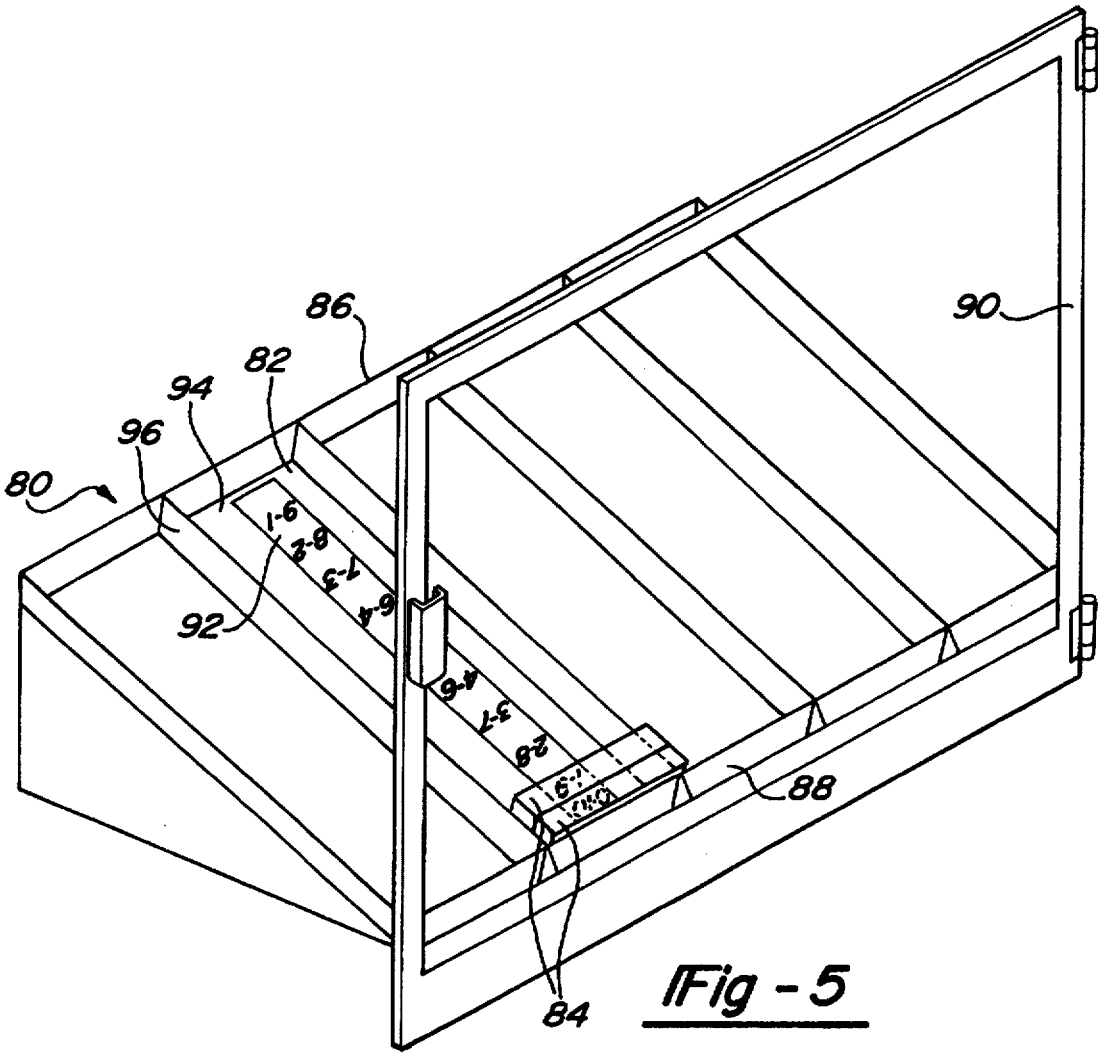
FIG. 5 is a perspective view of an angled shelving unit which incorporates the teachings of the present invention.

FIG. 5 depicts a further alternate embodiment of the present invention utilized in conjunction with an angled shelving unit 80 which provides a plurality of channels 82 to separate columns of the product 84 to be dispensed. This particular type of shelving unit is often found in walk-in refrigerators where the product 84 is loaded from a rear, refrigerated side 86 of unit 80 and is removed from a forward, dispensing side 88 where product 84 is viewed by the consumer through a glass door 90. Attached to shelving unit 80 is a strip member 92 containing the paired sets of numbers previously described. Strip member 92 may either be positioned on a surface 94 below product 84, or on a side wall 96 of each channel. In the particular instance described, the sets of numbers are oriented to face the rear side 86 of unit 80 such that an operator standing inside the walk-in refrigerator can properly read the numbers. As product 84 is removed from dispensing side 88 the remaining product shifts downward. As a result an increasing portion of strip member 92 is exposed, thereby displaying the pairs of numbered sets which sequentially indicate the amount of product 84 remaining and the amount required to fill each channel 82.

While the present invention has been described in conjunction with specific embodiments thereof, one skilled in the art will readily recognize from such discussion, and from the accompanying drawings and claims, that various changes, modifications, and variations can be made therein without departing from the true spirit and fair scope of the invention as defined in the following claims.

What is claimed is:

1. An inventory control system for tracking discrete items stored in and dispensed from a device, the system comprising:

a storage area for storing the items prior to being dispensed;

means for providing a visual indication of the quantity of said items remaining in said storage area;

said visual indication means being located such that the non-dispensed items block the view of a concealed portion of the visual indication means while an exposed portion of said visual indication means indicates the quantity of items remaining in said storage area.

2. The inventory control system of claim 1 wherein said exposed portion of said visual indication means further indicates the quantity of items required to fill said storage area.

3. The inventory control system of claim 1 wherein said visual indication means includes a generally planar strip member having a first set of symbols at predetermined, spaced intervals corresponding to stored locations of said items, said first set of symbols beginning at one end of said strip member and sequentially increasing in numeric value such that the quantity of said items remaining in said storage area can be observed by reference to an exposed portion of said first set of symbols.

4. The inventory control system of claim 3 wherein said visual indication means has a second set of symbols coordinated with said first set of symbols, said second set of symbols beginning at said one end and sequentially decreasing in numeric value such that the quantity of said items required to fill said storage area can be observed by reference to an exposed portion of said second set of symbols.

5. The inventory control system of claim 1 wherein the storage and dispensing device includes a plurality of dispensing mechanisms for holding and dispensing said items and said visual indication means includes an equal number of generally planar strip members, each said strip member corresponding to one of said plurality of dispensing mechanisms and having a first set of symbols at predetermined, spaced intervals corresponding to stored locations of said items, said first set of symbols beginning at one end of said strip member and sequentially increasing in numeric value, each said strip member being located such that the non-dispensed items in each said mechanism blocks the view of a concealed portion of said first set of symbols while an exposed portion of said first set of symbols indicates the quantity of items remaining in said mechanism.

6. The inventory control system of claim 5 wherein said strip members each have a second set of symbols coordinated with said first set of symbols, said second set of symbols beginning at said one end of each of said strip members and sequentially decreasing in numeric value such that the quantity of said items required to fill said mechanism can be observed by reference to an exposed portion of said second set of symbols.

7. The inventory control system of claim 5 wherein said storage and dispensing device includes a plurality of trays, and wherein said strips are affixed to the trays.

8. A method for tracking dispensable items in a vending machine, said machine having a dispensing mechanism for holding a plurality of items and which dispenses the items in an ordered sequence, said method comprising:

providing a generally planar strip having a first set of symbols spaced at intervals corresponding to locations where items are held in said dispensing mechanism, said first set of symbols beginning at one end of said strip and sequentially increasing in numeric value, said strip having a second set of symbols adjacent to said first set, said second set of symbols beginning at said one end of said strip and sequentially decreasing in numeric value;

placing the strip adjacent the dispensing mechanism such that each non-dispensed item therein blocks the view of a pair of said first and second symbols corresponding to the location of said item;

looking through said dispensing mechanism onto said strip to determine the quantity of items remaining in the dispensing mechanism by reference to the visible symbols of said first set of symbols, and determining the quantity of items required to fill said dispensing mechanism by reference to the visible symbols of said second set of symbols.

9. The method of claim 8 wherein said dispensing mechanism is a helical coil located above a tray, and wherein said strip is attached to said tray beneath said coil.

10. An inventory control system for use in a vending machine, said vending machine having a series of helical coils rotatably attached to a tray, each of said coils being configured such that the distance between the flights of each said coil provides space for items to be placed and held within the flights of said coil, as said coil is rotated said items are forced along said coil until said items are sequentially driven off one end of said coil and falls, into a vending bin, said inventory control device comprising:

a generally planar strip member having a first end coordinated with said one end of said coil; and attachment means for affixing said strip member to said tray, said strip member being attached to said tray and located such that items held in said coil block the view of a corresponding portion of said strip member.

11. The inventory control device of claim 10 wherein said strip member includes a set of numeric symbols, said symbols beginning at said first end of said strip member and increasing in numeric value, said symbols corresponding to said items remaining in said coil.

12. The inventory control device of claim 10 wherein said strip member includes a set of numeric symbols, said symbols beginning at said first end of said strip member and decreasing in numeric value, said symbols corresponding to said items required to fill said coil.

13. The inventory control device of claim 10 wherein said strip member includes a series of numeric symbols, said numeric symbols including a first set of numbers increasing in numeric value, said first set of numbers beginning at said first end of said strip member and corresponding to said items remaining in said coil, said numeric symbols include a second set of numbers adjacent said first set of numbers and decreasing in numeric value, said second set of numbers beginning at said first end of said strip member and corresponding to the number of items required to fill said coil.

14. An inventory control device for use in a vending machine, said vending machine having a storage and dispensing mechanism for storing and dispensing a plurality of items, the device comprising:

a generally planar strip member having a first and second set of numeric symbols located thereon, said symbols being at spaced intervals coordinated with storage locations of said items along said mechanism, said first set of numbers increasing in numeric value and said second set of numbers decreasing in numeric value, said first set indicating the number of said items remaining in said mechanism, said second set indicating the number of said items required to fill said mechanism.

15. The inventory control device of claim 14 wherein said numeric symbols are located on the strip such that items remaining in said mechanism block the view of a portion of said numeric symbols.

16. The inventory control device of claim 14 further comprising a tray, said storage and dispensing mechanism being in operative relation to said tray, and said strip member being affixed to said tray.

* * * * *